US008876538B2

(12) United States Patent
Shiraishi et al.

(10) Patent No.: US 8,876,538 B2
(45) Date of Patent: Nov. 4, 2014

(54) CONNECTOR

(71) Applicant: J.S.T. Mfg. Co., Ltd., Osaka (JP)

(72) Inventors: Makoto Shiraishi, Miyoshi (JP); Kentaro Hayashi, Miyoshi (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 85 days.

(21) Appl. No.: 13/765,995

(22) Filed: Feb. 13, 2013

(65) Prior Publication Data

US 2013/0217278 A1 Aug. 22, 2013

(30) Foreign Application Priority Data

Feb. 16, 2012 (JP) ..... 2012-032048

(51) Int. Cl.
*H01R 13/514* (2006.01)

(52) U.S. Cl.
USPC ..... 439/79; 439/733.1

(58) Field of Classification Search
USPC ..... 439/79, 733.1
See application file for complete search history.

(56) References Cited

U.S. PATENT DOCUMENTS 6,835,107 B2 * 12/2004 Wu ..... 439/856
7,021,975 B2 * 4/2006 Lappohn ..... 439/733.1
7,645,172 B2 * 1/2010 Imai ..... 439/733.1
7,708,605 B2 * 5/2010 Shibata et al. ..... 439/733.1
7,828,608 B2 * 11/2010 Aihara et al. ..... 439/752
2005/0026472 A1 * 2/2005 Lee et al. ..... 439/79
2006/0134949 A1 * 6/2006 Wang ..... 439/79
2007/0197059 A1 * 8/2007 Tanaka ..... 439/79

FOREIGN PATENT DOCUMENTS

JP H10-154537 6/1998
JP 2000-215951 8/2000
JP 2001-143792 A1 5/2001

* cited by examiner

*Primary Examiner* — Gary Paumen
(74) *Attorney, Agent, or Firm* — Kratz, Quintos & Hanson, LLP

(57) ABSTRACT

A connector includes a housing and contacts. Each of the contacts includes a leading end, a connecting part, a held part, and a flange part. The housing has a holding part having a contact insertion hole into which the held part is inserted. The contact insertion hole includes: a first insertion hole in which a side surface of the held part of the contact is held; a second insertion hole formed in a size that holds one opposite side surface of the held part of the contact, and having a space on the other opposite side surface side, the second insertion hole being formed to be longer than the first insertion hole; and a flange holding part. The held part of the contact is made longer than the leading end of the contact. This configuration can improve alignment accuracy of the contacts without using a compensation plate.

15 Claims, 13 Drawing Sheets

10
11
12
14
15
16
17
18
19
19a
19b
19c
20
20a
30
IIIA
IIIB
IV

30

CONNECTOR

TECHNICAL FIELD

The present invention relates to a connector having a plurality of contacts mounted on a substrate. Specifically, the present invention relates to a connector that can improve alignment accuracy of the contacts without using other components such as a compensation plate for aligning the contacts when the connector is mounted on the substrate.

BACKGROUND ART

A connector has been used for connecting an electronic control system installed in a vehicle such as an automobile with other electronic devices. However, because of ever-increasing multifunctionality and high performance of electronic devices in recent years, the devices themselves have been made smaller and become space-saving, and the number of contact terminals provided in the connector has increased. Conversely, the footprint of connectors mounted on the substrate has been reduced and the contact terminals have become more closely arranged.

Such a connector generally includes a housing, a contact terminal, and a compensation plate (also referred to as a locator or a tine plate). A compensation plate is used for improving alignment accuracy of the leading end of a contact terminal on the substrate side, and it is required for preventing abutment of the leading end of the contact terminal on the substrate, deformation of the contact terminal due to the abutment, and difficulty of insertion of the contact terminal into a through hole, by improving the alignment accuracy when the contact terminal is assembled on the through hole formed in the substrate.

JP-A-2001-143792 discloses a locator for insertion of contact provided to a connector to prevent deformation of the contact. The locator for insertion of contact includes a flat-plate part made of plastic such as PBT (polybutylene terephthalate), and a bending part that is elastically deformable and formed integrally with the flat-plate part. The connector includes an insulator mounted on a substrate such as a print circuit board and a plurality of electrically conductive contacts assembled with the insulator. The locator is positioned between a wall of the insulator and the substrate, and functions to prevent deformation of a terminal part while connected to the substrate and to suppress occurrence of solder cracking.

JP-A-10-154537 discloses a board-attached type connector. The board-attached type connector includes an insulating housing made of plastic such as PBT entirely formed in a substantially rectangular parallelepiped shape, a plurality of arrays of male contacts fixed to a back wall of the insulating housing, and a tine plate. Leg parts, extending from the back wall of the insulating housing of the contact externally backward, bending in the middle portion and extending toward the substrate, are aligned by the tine plate.

JP-A-2000-215951 discloses a board-mounting type connector. The board-mounting type connector includes a first connector part and a second connector part. The first connector part includes a first insulating housing and a plurality of first contacts that are press-fitted and fixed into the first housing. The first contacts include press-fit parts press-fitted into the circuit board. Above each of the press-fit parts, a pressed-shoulder part to be collectively pressed by a press jig when the press-fit parts are press-fitted and fixed to the circuit board is formed. The pressed-shoulder part of the first contact is inserted into an opening of the tine plate, and aligns the press-fit parts by the tine plate when the press-fit part is press-fitted and fixed to the circuit board.

The connectors or the like disclosed in JP-A-2001-143792, JP-A-10-154537, and JP-A-2000-215951 require a compensation plate such as a locator or a tine plate to align the contacts when assembling or mounting so that alignment accuracy of the contacts is improved. However, there is a problem that the number of parts increases when the compensation plate is used in the connector. In addition, increase in the number of parts leads to an increase in assembly man-hours, and the footprint of parts on the substrate becomes large, so that downsizing and space-saving of the connector may not be achieved. If the compensation plate is used, the compensation plate and the contact may contact each other when the connector oscillates, so that shavings may be generated to cause trouble in the connector and other devices. Additionally, if temperature change is caused in the device when the contact is attached to the substrate by soldering, stress load may be applied to the soldered portion due to difference between linear expansion coefficients of the compensation plate and the substrate, and cracks may occur in the solder to cause trouble in the connection between the contact and the substrate.

SUMMARY

Taking the forgoing into account, the present invention provides a connector in which a holding part holding contacts of a housing composing a connector is formed to be long so as to reduce the length of each of the contacts connected with the substrate protruding from the housing, so that alignment accuracy of the contacts can be improved when the connector is mounted on the substrate without using a compensation plate, the contact can be prevented from being damaged or deformed, and the number of parts can be reduced.

A connector according to a first aspect of the invention includes a plurality of contacts and a housing including the contacts, and attached to a substrate. The housing includes a mounting part to which a counterpart connector is mounted and a holding part extended from the mounting part and holding the contacts. Each of the contacts includes a leading end protruding from the housing, a connecting part connected with the counterpart connector on the opposite side of the leading end, a held part held by the holding part of the housing, and a flange part formed on the connecting part side of the held part. The holding part of the housing has a contact insertion hole into which the held part of the contact is inserted. The contact insertion hole includes: a first insertion hole formed in a size that holds a side surface of the held part of the contact on the opposite side of the mounting part of the housing; a second insertion hole communicating with the first insertion hole and formed in a size that holds one opposite side surface of the held part of the contact, and having a space on the other opposite side surface side, the second insertion hole being formed to be longer than the first insertion hole; and a flange holding part that holds the flange part of the contact on the mounting part side of the second insertion hole. The held part of the contact is longer than the leading end of the contact.

A connector according to a second aspect of the invention is configured so that, in the connector according to the first aspect, the held part of the contact includes a protruding part protruding from a side surface of the housing held in the second insertion hole.

A connector according to a third aspect of the invention is configured so that, in the connector according to the first aspect, the housing is arranged so that the contact insertion hole is parallel to the substrate, the housing has at least two arrays of such contact insertion holes, the contact is formed so that the leading end bends toward the substrate, the lower holding part of the housing closest to the substrate is formed to be the shortest, and the holding part is formed to be longer toward an upper portion of the housing.

A connector according to a fourth aspect of the invention is configured so that, in the connector according to the second aspect, the housing is arranged so that the contact insertion hole is parallel to the substrate, the housing has at least two arrays of such contact insertion holes, the contact is formed so that the leading end bends toward the substrate, the lower holding part of the housing closest to the substrate is formed to be the shortest, and the holding part is formed to be longer toward an upper portion of the housing.

A connector according to a fifth aspect of the invention is configured so that, in the connector according to the third aspect, the holding part is integrally formed with each of the arrays.

A connector according to a sixth aspect of the invention is configured so that, in the connector according to the fourth aspect, the holding part is integrally formed with each of the arrays.

A connector according to a seventh aspect of the invention is configured so that, in the connector according to the third aspect, the leading end of the contact is bent immediately after protruding from the holding part of the housing.

A connector according to an eighth aspect of the invention is configured so that, in the connector according to the fourth aspect, the leading end of the contact is bent immediately after protruding from the holding part of the housing.

A connector according to a ninth aspect of the invention is configured so that, in the connector according to the fifth aspect, the leading end of the contact is bent immediately after protruding from the holding part of the housing.

A connector according to a tenth aspect of the invention is configured so that, in the connector according to the sixth aspect, the leading end of the contact is bent immediately after protruding from the holding part of the housing.

A connector according to an eleventh aspect of the invention is configured so that, in the connector according to the first aspect, the housing has at least an array of such contact insertion holes and the contacts are formed linearly.

A connector according to a twelfth aspect of the invention is configured so that, in the connector according to the second aspect, the housing has at least an array of such contact insertion holes and the contacts are formed linearly.

A connector according to a thirteenth aspect of the invention is configured so that, in the connector according to the first aspects, the contacts are formed of wire rods.

A connector according to a fourteenth aspect of the invention is configured so that, in the connector according to the first aspects, each of the contacts has a cross-sectional shape of a square, a rectangle, a circle, or an ellipse.

A connector according to a fifteenth aspect of the invention is configured so that, in the connector according to the first aspect, the space in the second insertion hole of the housing is filled with filler.

With the connector according to the first aspect, the holding part holding each of the contacts formed on the housing is extended to be long, and the held part of the contact is longer than the leading end of the contact, therefore the contact is stably held by the holding part of the housing. In addition, the length of the leading end protruding from the housing is short, so that alignment accuracy of the leading end can be improved when attached to the substrate without using other members such as a compensation plate. Although the holding part is formed to be long, the second insertion part holds only one opposed side surface of each of the contacts and the space is provided to the other opposed side surface, so that the contact is smoothly inserted into the contact insertion hole when assembling the connector. The first insertion hole of the holding part holds a side surface of the held part of the contact, and the flange holding part formed on the mounting part side of the second insertion part holds a flange part formed on the contact, so that movement of the contact can be regulated and the contact can be rigidly held. Since the housing includes the flange holding part, the flange part of the contact is held by the flange holding part. Therefore, positioning of the contacts can be accurately performed.

With the connector according to the second aspect, although the second insertion hole of the holding part only holds one opposed side surface of the contact, the protruding part is formed on the held part of the contact positioned at the second insertion hole, so that positioning can be more accurately performed and the contacts can be prevented from falling out.

With the connector according to the third and the fourth aspect, even with a so-called side-type connector in which the substrate and the contacts are provided in parallel with each other, the same effects as those in the first and the second aspects can be obtained. Even when two or more arrays of contacts are vertically provided, the lowermost holding part is the shortest and the holding part is formed to be longer toward the upper part of the housing, so that the upper contacts and the lower contacts can be prevented from contacting each other. Both in the short holding part and the long holding part, the leading end of the contact is shorter than the held part of the contact held by the holding part, so that alignment accuracy can be improved and other members such as a compensation plate can be omitted.

With the connector according to the fifth and the sixth aspect, strength of the holding part holding the contacts can be enhanced and the manufacture of the housing is facilitated.

With the connector according to the seventh to the tenth aspect, the length of the leading end of each of the contact protruding from the holding part can be further reduced, so that the alignment accuracy can be more improved. In this case, the length of the holding part is adjusted to correspond to a through hole formed in the substrate. As a result, the contact can be more rigidly held and the alignment accuracy of the leading end can be improved.

With the connector according to the eleventh and the twelfth aspect, even with a so-called top-type connector attached to the substrate at a right angle, the same effects as those in the first and the second aspects can be obtained.

With the connector according to the thirteenth aspect, since the contacts are formed of wire rods, they are resistant to stress applied in the drawing direction and can prevent breakage such as bending when connecting the connector with the substrate or other connector. In addition, materials can be used without waste as compared to a case of stamping out a plate material.

With the connector according to the fourteenth aspect, if the cross-sectional shape of the contact is a square or a rectangle, the contact can be prevented from rotating when inserted into the contact insertion hole. Since the side surface of the contact is flat, other components can be easily made on the side surface of the contact. The cross-sectional shape of the contact may be a circle or an ellipse, so that the range of design can be expanded. In this case, the shape of the contact insertion hole corresponds to the shape of the contact.

With the connector according to the fifteenth aspect, holding power of the contact can be more enhanced since the space provided for facilitating insertion of the contact is filled with filler. In addition, airtightness can be enhanced due to the filled filler, so that ingress of liquid can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the drawings. However, the embodiments described below only exemplify a connector for the purpose of embodying the technical idea of the invention and are not intended to limit the invention thereto. The present invention is also applicable to other embodiments included in the scope of claims.

Embodiment 1

Figure 1A:
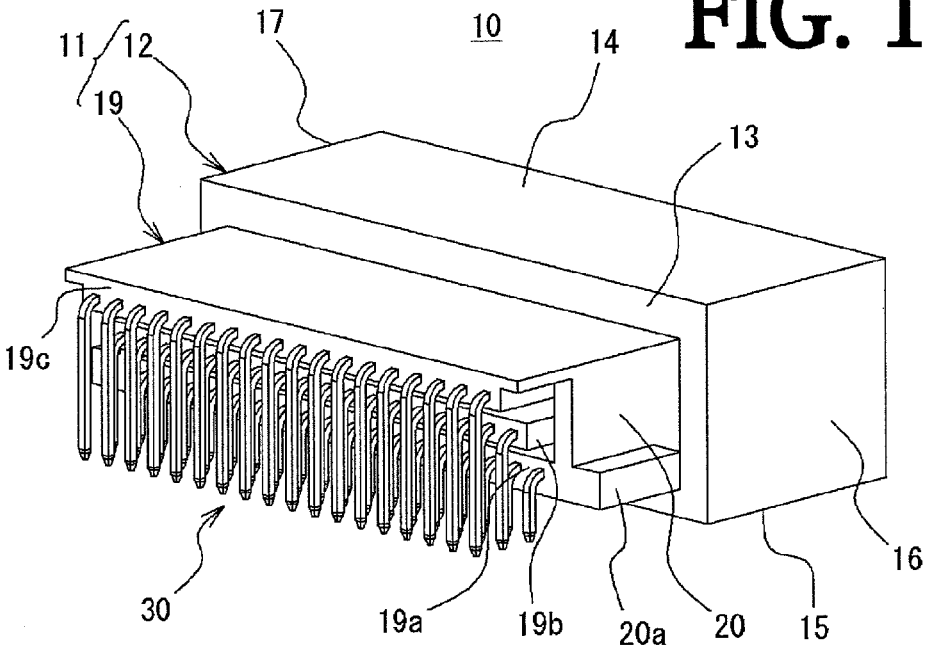
FIG. 1A is a perspective view of a connector according to Embodiment 1.
Figure 1B:
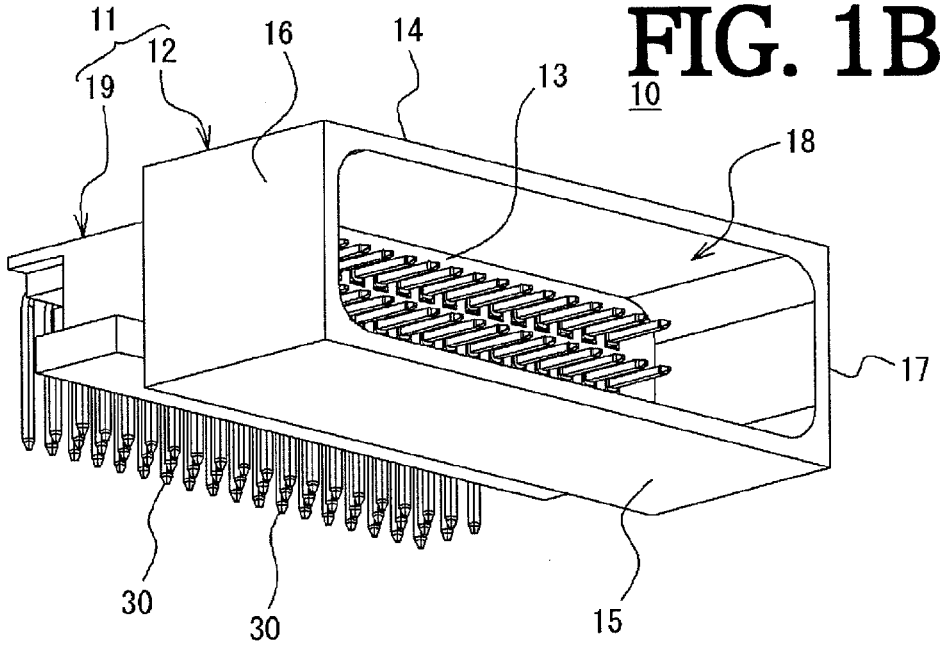
FIG. 1B is a perspective view as viewed from other direction.
Figures 2A, 2B, 2C, 2D, 2E, 2F:
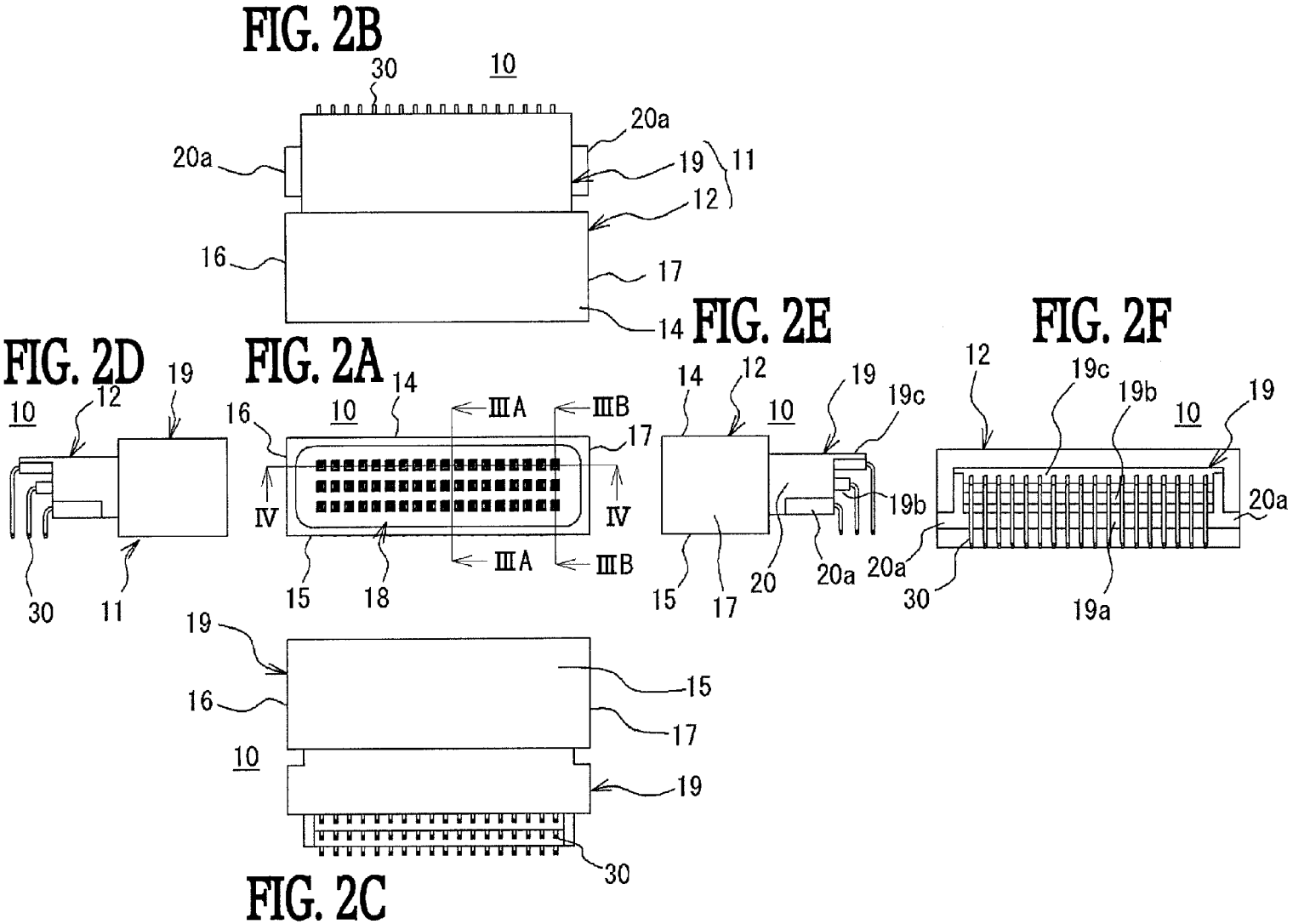
FIG. 2A is a front view of the connector according to Embodiment 1.
FIG. 2B is a top view thereof.
FIG. 2C is a bottom view thereof.
FIG. 2D is one side view thereof.
FIG. 2E is the other side view thereof.
FIG. 2F is a back view thereof.

With reference to FIGS. 1 to 8, a connector according to Embodiment 1 will be described. As illustrated in FIGS. 1 and 2, a connector 10 of Embodiment 1 includes a housing 11 formed of insulating material and a plurality of contacts 30 mounted on the housing 11. The connector 10 of Embodiment 1 is a so-called side-type connector 10 (refer to FIG. 8) in which the contacts 30 mounted on the housing 11 are parallel to a substrate 36, so that leading ends of the contacts 30 to be described later are bent at a substantially right angle to be orthogonal to the substrate 36. The connector 10 of Embodiment 1 is described using a connector in which three arrays of the contacts 30 are arranged. Hereinbelow, each of the components will be described.

The housing 11 of Embodiment 1 includes a mounting part 12 mounted to a counterpart connector (not shown) and a holding part 19 extended from the mounting part 12 by a predetermined length and holding the contacts 30, and is integrally formed of insulating material.

The mounting part 12 is enclosed by a back wall 13 that is part of the holding part 19, a plate-like upper wall 14, a lower wall 15, and both side walls 16 and 17 that are provided at respective sides of the back wall 13 and have predetermined area and thickness. The mounting part 12 has a box shape in which an opening 18 is formed at the position opposed to the back wall 13. The mounting part 12 is formed in an arbitrary size and shape corresponding to a counterpart connector to be mounted.

As illustrated in FIGS. 1 to 4, the holding part 19 is extended from the mounting part 12 of the housing 11 by a predetermined length to be long, and formed by a plate-like member as a unit for each of the arrays where the contacts 30 are arranged. In the connector 10 according to Embodiment 1, since the contacts 30 are arranged in three arrays, the holding part 19 is also formed by three arrays of plate-like members such as a first holding part 19*a*, a second holding part 19*b*, and a third holding part 19*c*. Hereinafter, the first to third holding parts 19*a* to 19*c* may be simply referred to as the holding part 19 in some cases.

With respect to the lengths of the first to third holding parts 19*a* to 19*c* extended from the mounting part 12, the first holding part 19*a* closest to the substrate 36 is the shortest, and upper holding part has longer length. Accordingly, the contacts mounted in different arrays can be prevented from contacting each other when connected to the substrate.

Each plate-like member of each of the first to third holding parts 19*a* to 19*c* is extended from the back wall 13 of the mounting part 12, and an end face 28 of each plate-like member is formed on an opposite side of the mounting part 12. Contact insertion holes 21 to which the contacts 30 are inserted at predetermined intervals are formed inside the plate-like members, so that an inlet 22 formed on the back wall 13 and an outlet 23 formed on the end face 28 are communicated with each other. A flange holding part 27 is formed on the inlet 22 so that a flange part 33 formed on the contact 30 to be described later can be held. A holding part side wall 20 connecting both side surfaces of the plate-like members of the first to third holding parts 19*a* to 19*c* is formed on the holding part 19, and the holding parts 19*a* to 19*c* are integrally formed due to the holding part side wall 20. The holding part side wall 20 is formed with substantially the same width as the length of the extended first holding part 19*a*. Therefore, the upper holding parts are protruding from the holding part side wall. The holding part side wall 20 may be formed in a stepped shape corresponding to the lengths of the respective holding parts.

The first holding part 19*a* positioned at the lowermost part of the holding part 19 has an installation part 20*a* formed to be laterally protruding from the holding part side wall 20. The installation part 20*a* is formed with substantially the same length as the width of the mounting part 12 of the housing 11. A lower side of the first holding part 19*a* is a portion that directly contacts the substrate 36. Therefore, the first holding part 19*a* is made broad to increase the area contacting the substrate 36, so that the first holding part 19*a* can be stably arranged and mounted on the substrate (refer to FIGS. 1, 2, and 8).

Next, the contact insertion hole 21 will be described with reference to FIGS. 3 to 6. The contact insertion holes 21 are formed in the first to third holding parts 19*a* to 19*c* and have different lengths depending on the holding part 19 to be formed. However, configurations of the contact insertion holes 21 are common, so that the contact insertion hole 21 of the third holding part 19*c* will be described as a representative. The contact insertion hole 21 includes a first insertion hole 24 formed on the end face 28 side of the holding part 19 and communicating with the outlet 23, and a second insertion hole 25 formed on the back wall 13 side of the holding part 19 and communicating with the inlet 22.

Figure 6A:
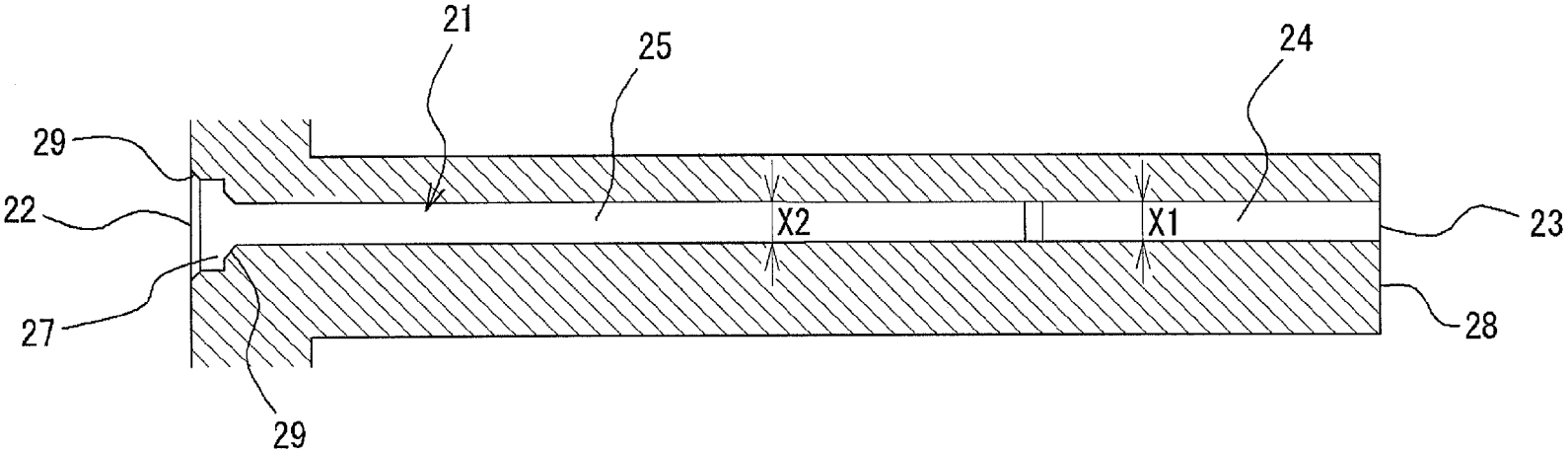
FIG. 6A is an enlarged cross sectional view of FIG. 5A in a state where a contact is removed.
Figure 6B:
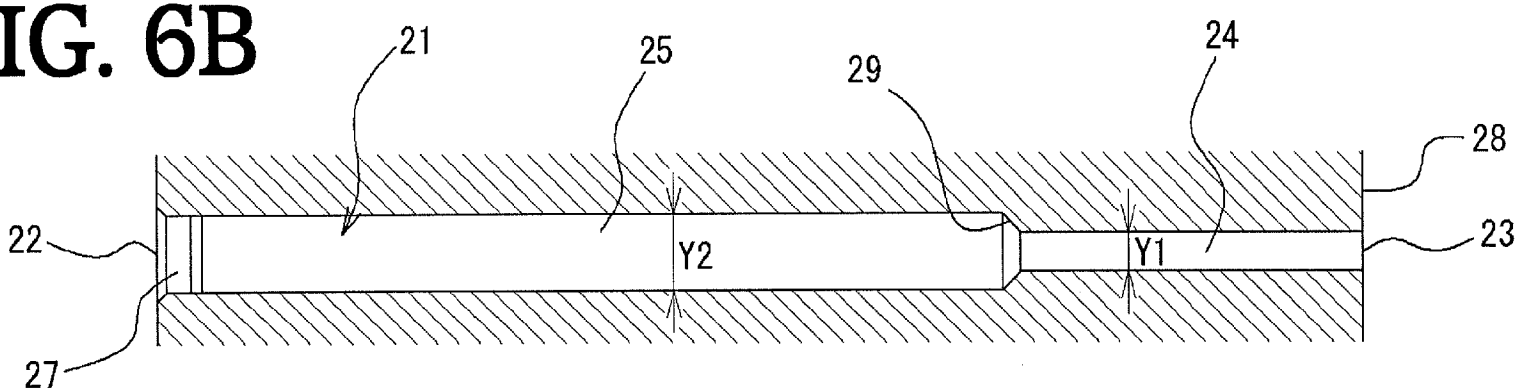
FIG. 6B is an enlarged cross sectional view of FIG. 5B in a state where a contact is removed.

The cross-sectional area of the first insertion hole 24 is made smaller than the cross-sectional area of the second insertion hole 25, and the length of the first insertion hole 24 is made shorter than the length of the second insertion hole 25. Specifically, as illustrated in FIG. 6, the first insertion hole 24 is formed with substantially the same height X1 and width Y1 as those of the held part 34 of the contact 30 to be described later. On the other hand, although one opposed height of the second insertion hole 25 is substantially the same height X2 as the width of the held part 34 of the contact 30, the other opposed width thereof is larger width Y2 than the width of the held part 34 of the contact 30. When the contact 30 is inserted into the second insertion hole 25, a space 26 is provided outside the contact 30 in the second insertion hole 25. The height and the width referred to herein corresponds to the orientation of the housing with respect to the substrate.

The broad width of the second insertion hole 25 is preferably formed to be 1.5 to 2.5 times the height, which is not broad. Accordingly, the cross-sectional area (X2×Y2) of the second insertion hole 25 is formed to be about 1.5 to 2.5 times larger than the cross-sectional area (X1×Y2) of the first insertion hole 24. The broad portion of the second insertion hole 25 is laterally formed with respect to the orientation of the housing 11 in Embodiment 1, but it may be vertically formed. In this case, all the broad portions are preferably formed in the same direction.

In the contact insertion hole 21, in order to smoothly insert the contact 30 to be described later, each of tapers 29 is formed at a boundary between the first insertion hole 24 and the second insertion hole 25, a boundary between the second insertion hole 25 and the flange holding part 27, and a boundary between the flange holding part 27 and the inlet 22, respectively (refer to FIG. 6).

The lengths of the contact insertion holes 21 are different depending on the lengths of the first to third holding parts 19*a* to 19*c*. Similarly, the lengths of the first insertion holes 24 and the second insertion holes 25 are changed according to the lengths of the first to third holding parts 19*a* to 19*c*. The flange holding parts 27 are all formed in the same size because the shapes and the sizes of the flange parts 33 formed on the contacts 30 are the same (refer to FIG. 3B).

Figure 5A:
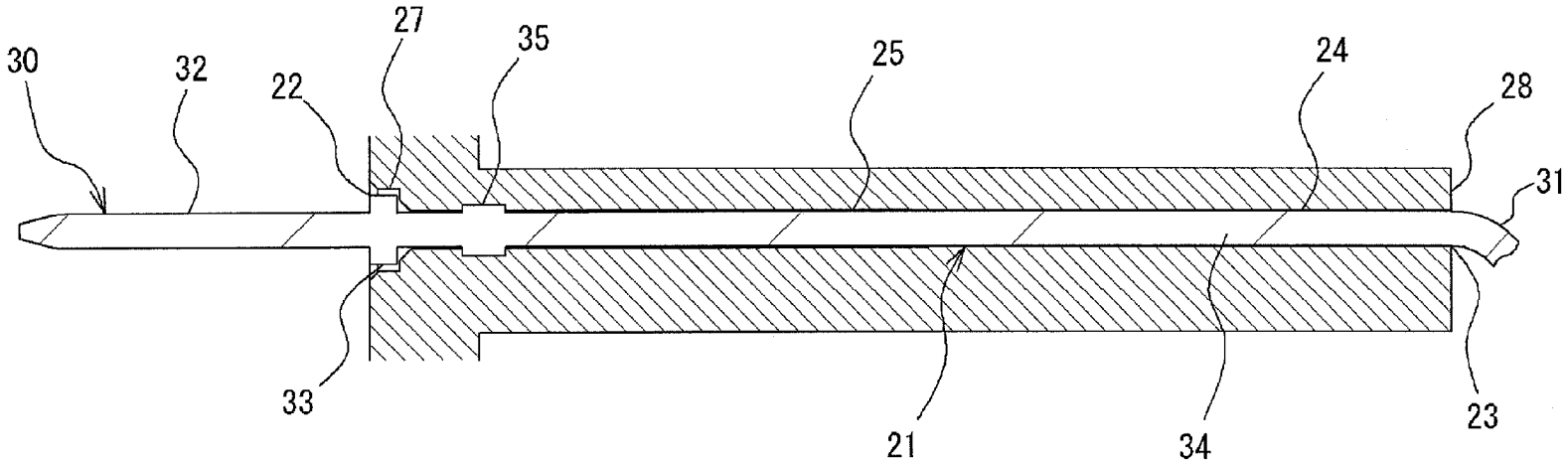
FIG. 5A is a partially enlarged cross sectional view of FIG. 3B.
Figure 5B:
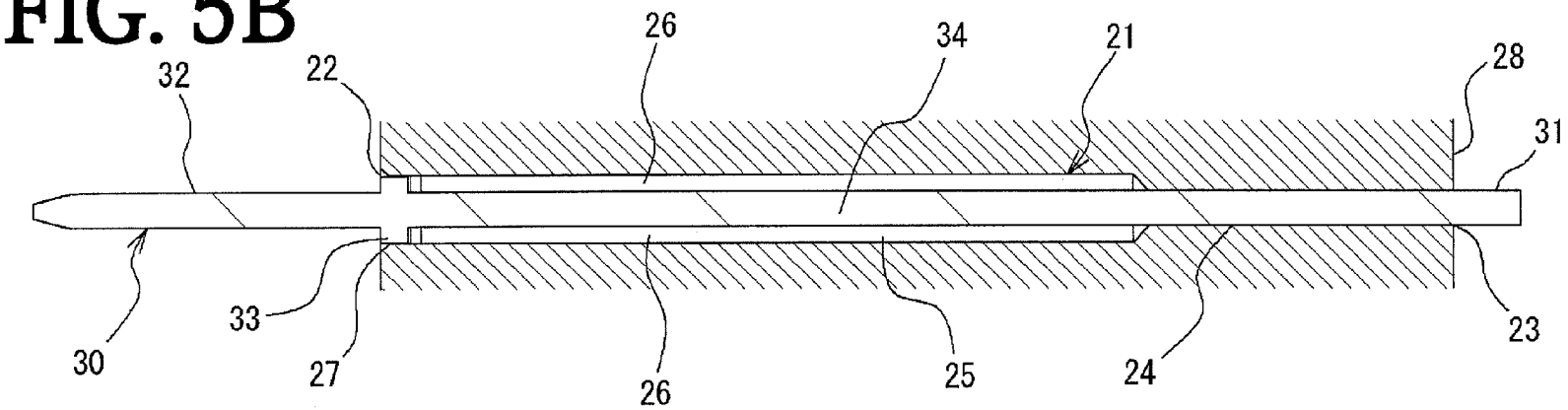
FIG. 5B is a partially enlarged cross sectional view of FIG. 4.
Figure 7:
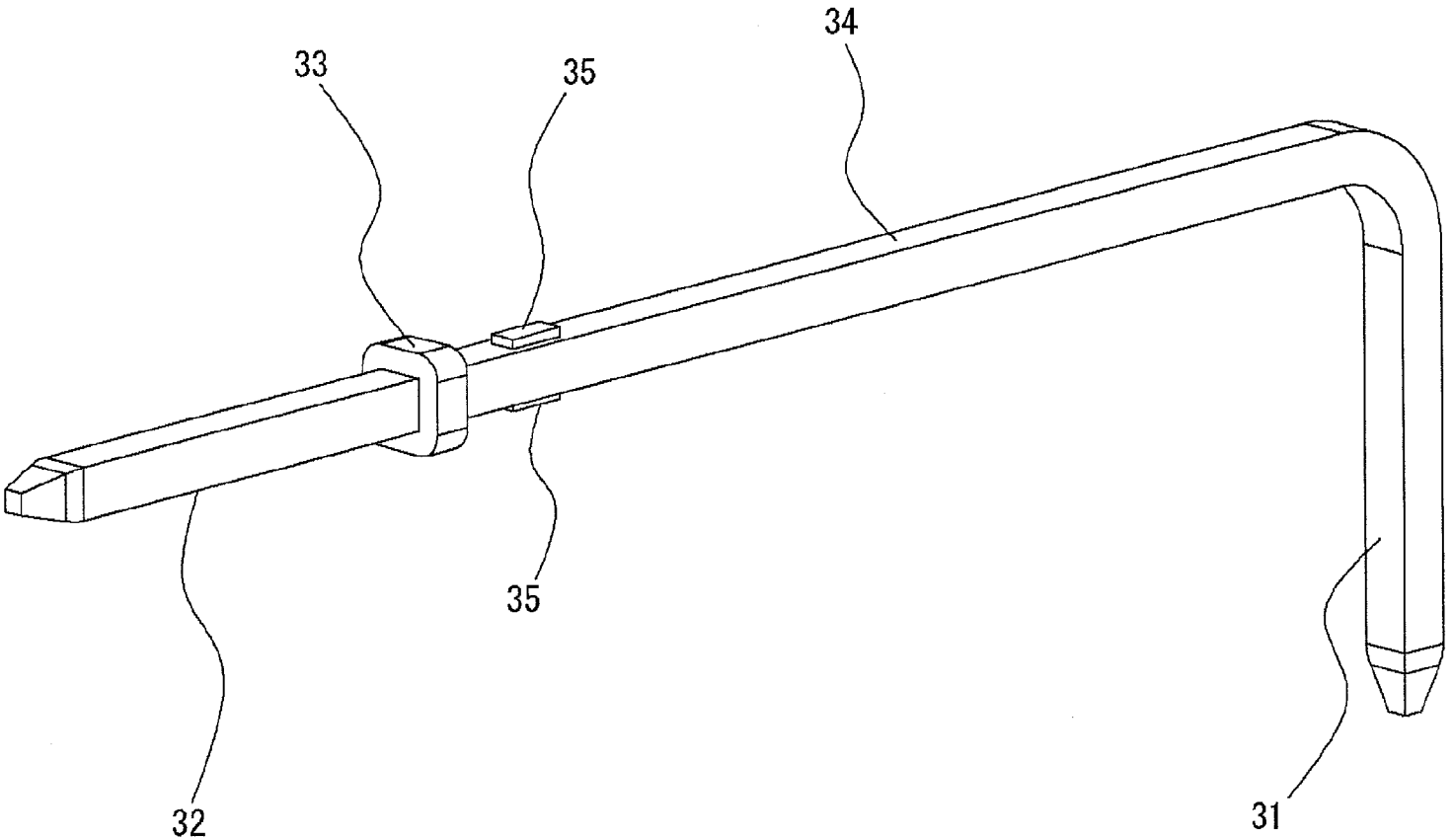
FIG. 7 is a perspective view of the contact.

Next, the contact 30 will be described. The contacts 30 are different in length depending on the first to third holding parts 19*a* to 19*c* of the housing 11 to be mounted. However, configurations of the contacts 30 are common, so that the contact 30 mounted on the third holding part 19*c* will be described as a representative. As illustrated in FIGS. 5 and 7, the contact 30 used in Embodiment 1 is formed of a wire rod having a square-shape cross section and a predetermined length. The contact 30 includes a leading end 31 protruding from the outlet 23 of the end face 28 of the housing 11 and attached to the substrate 36, a connecting part 32 being present inside the mounting part 12 of the housing 11 and protruding from the inlet 22 of the back wall 13 to be connected with the counterpart connector, and the held part 34 held by the holding part 19 of the housing 11.

In the held part 34, the flange part 33 formed on the connecting part 32 side of the held part 34 and inserted into the flange holding part 27 formed on the back wall 13 is formed to be larger than the cross-sectional area of the held part 34 of the contact 30. Protruding parts 35 to be press-fitted into the contact insertion hole 21 of the housing 11 are protruding and formed on a pair of opposed side surfaces of the held part 34. Each of the protruding parts 35 is provided so that the width formed in the second insertion hole 25 corresponds to the side having substantially the same width as that of the held part 34 of the contact 30. In other words, in Embodiment 1, the protruding parts 35 are formed on the upper and lower side surfaces of the held part 34, which is vertical to the housing 11. Accordingly, the protruding part 35 of the contact 30 is press-fitted into the second insertion hole 25 of the holding part 19 of the housing 11, so that the positioning of the contact 30 can be performed and falling out of the contact 30 can be prevented.

Since the connector 10 according to Embodiment 1 is a so-called side-type connector, the contact 30 mounted on the connector 10 become parallel to the substrate 36. Therefore, the leading end 31 of the contact 30 is bent at a substantially right angle so that the contact 30 can be connected to the substrate 36.

Figure 3A:
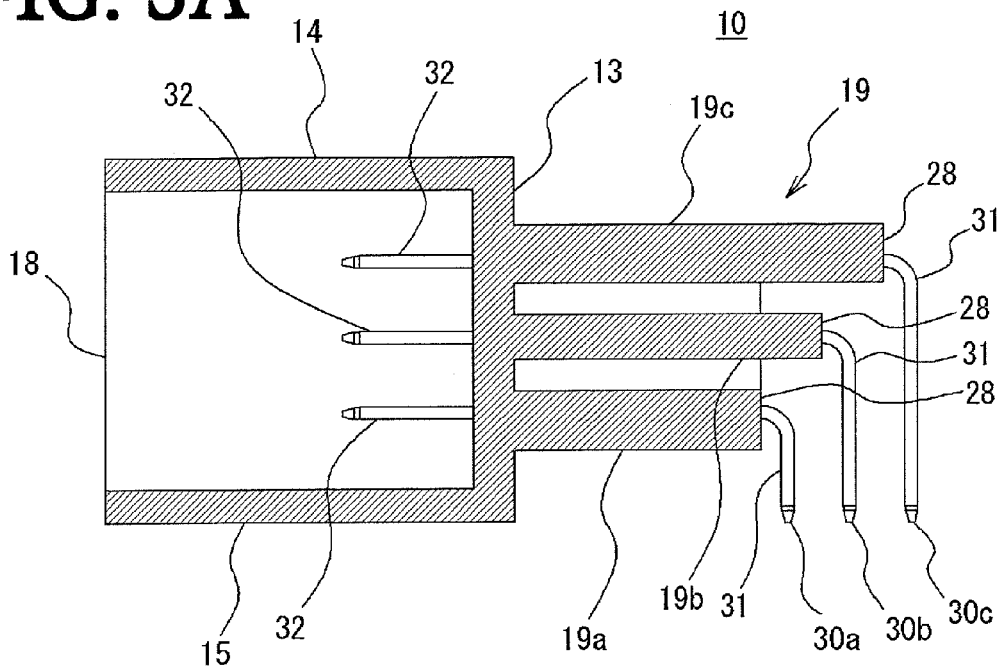
FIG. 3A is a cross sectional view taken along a line IIIA-IIIA of FIG. 2A.
Figure 3B:
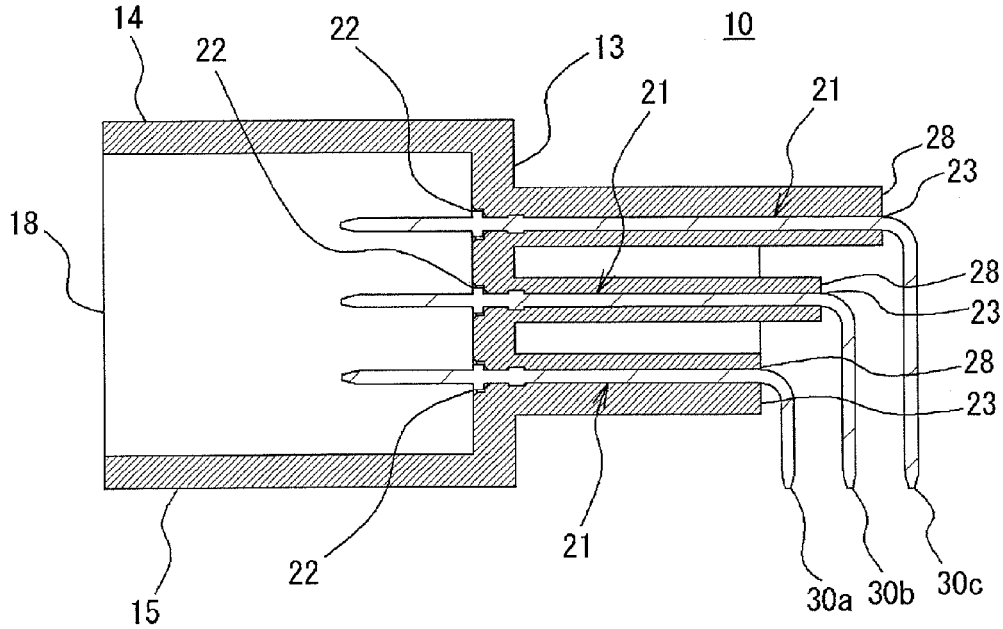
FIG. 3B is a cross sectional view taken along a line IIIB-IIIB of FIG. 2A.
Figure 4:
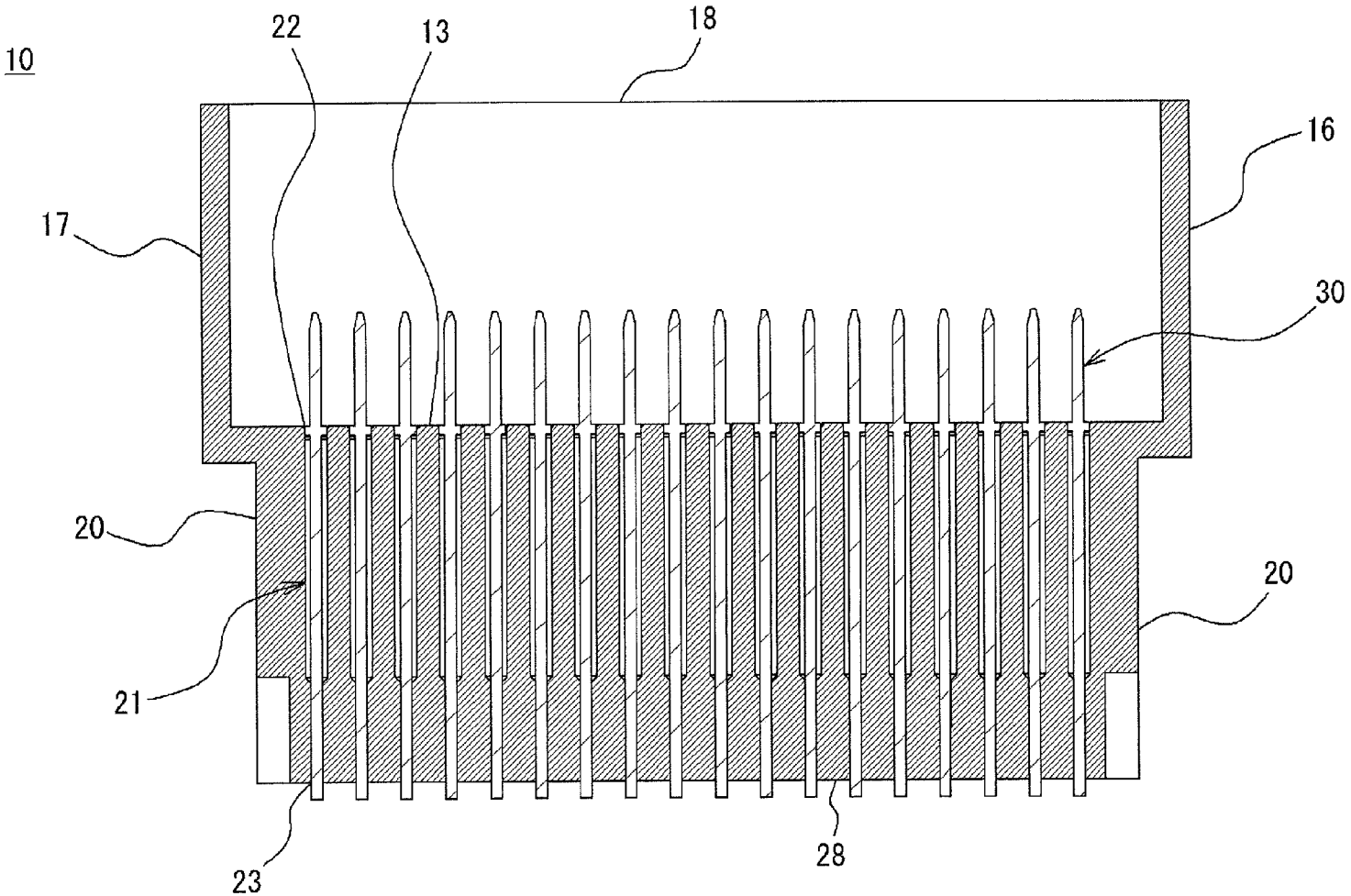
FIG. 4 is a cross sectional view taken along a line IV-IV of FIG. 2A.

The contacts 30 are different in length depending on which one is to be mounted: the first holding part 19*a*; the second holding part 19*b*; and the third holding part 19*c*, in the holding part 19 of the housing 11 (refer to FIG. 3). In other words, a contact 30*a* mounted on the first holding part 19*a* closest to the substrate 36 is short because it is close to the substrate 36 and the length of the first holding part 19*a* is short. The contact 30*b* mounted on the second holding part 19*b* is longer than the contact 30*a* provided to the first holding part 19*a*, because it is somewhat separated from the substrate 36 and the length of the second holding part 19*b* is somewhat long. Similarly, the contact 30*c* held by the third holding part 19*c* is the longest because it is separated from the substrate 36 and the length of the third holding part 19*c* is long. In some cases, the first to third contacts 30*a* to 30*c* may be simply referred to as the contact 30.

Next, assembling of the connector 10 according to Embodiment 1 will be described mainly with reference to FIGS. 3 to 6. The connector 10 is assembled such that the leading end 31 side of the contact 30 is inserted from the mounting part 12 side of the housing 11 into the contact insertion hole 21 of the holding part 19. At this time, the leading end 31 of the contact 30 is not bent yet. In the holding part 19 of the housing 11, since the first to third holding parts 19*a* to 19*c* are different in length, the contact 30 is inserted according to the length thereof corresponding to the lengths of the respective holding parts 19*a* to 19*c*. In this case, the insertion of the contact 30 may be started either at the first holding part 19*a* or the third holding part 19*c*.

The contact 30 is inserted into the housing 11 such that, first, the leading end 31 of the contact 30 is inserted into the inlet 22 of the contact insertion hole 21 of the holding part 19 of the housing 11. At this time, the contact 30 is oriented such that the protruding part 35 formed on the held part 34 of the contact 30 is oriented to correspond to the side in which the width of the second insertion hole 25 of the contact insertion hole 21 is the same as that of the contact 30, that is, the side that is not formed to be broad. By inserting the contact 30 in such orientation, the second insertion hole 25 is press-fitted to the protruding part 35 of the contact 30.

The orientation of the contact 30 is adjusted, and the contact 30 is inserted into the second insertion hole 25 and the first insertion hole 24 of the contact insertion hole 21 until the leading end 31 of the contact 30 is protruding from the outlet 23. The holding parts 19*a* to 19*c* are formed to be long. Therefore, if all the contact insertion holes are formed with the same size as the cross-sectional area of the held part 34 of the contact 30, resistance when inserting the contact increases and it becomes difficult to insert the contact. Accordingly, the contact may be broken or bent. However, in the connector according to Embodiment 1, one opposed side of the second insertion hole 25 is broadly formed and the space 26 is provided therein in the contact insertion hole 21, so that the resistance is reduced, the contact 30 can be easily inserted, and the contact is prevented from being damaged. On the other hand, since the holding part 19 of the housing 11 in which the contact 30 is held is formed to be long, sufficient holding power can be obtained even when the broad space 26 is formed in the second insertion hole 25.

Since a taper 29 is formed at each position where the cross-sectional area of the contact insertion hole 21 is changed, the contact 30 is smoothly inserted. The protruding part 35 formed on the held part 34 of the contact 30 is press-fitted to the narrow portion of the second insertion hole 25.

The contact 30 is inserted until the flange part 33 of the contact 30 is inserted and held in the flange holding part 27 formed on the inlet 22 side of the contact insertion hole 21. All the side surfaces of the held part 34 of the contact 30 are held in the first insertion hole 24 of the contact insertion hole 21, one opposed side surface of the held part 34 of the contact 30 is held in the second insertion hole 25 of the contact insertion hole 21 at the side where the width of the second insertion hole 25 is narrow, and the flange part 33 of the contact 30 is held by the flange holding part 27 of the contact insertion hole 21. As a result, the contact 30 can obtain high holding power at the holding part 19 of the housing 11. The flange part 33 of the contact 30 is held by the flange holding part 27 of the housing 11, so that the contact 30 can be positioned. In the same manner, the contacts are inserted in all the contact insertion parts formed in the holding parts of the housing.

Next, the leading end 31 of the contact 30 protruding from the outlet 23 of the holding part 19 of the housing 11 is bent at a substantially right angle toward the side connected to the substrate 36 immediately after protruding from the outlet 23. Accordingly, the length of the leading end 31 of the contact 30 protruding from the housing 11 is reduced, so that alignment accuracy can be improved. The contact may be bent one by one for inserted ones, or alternatively, may be collectively bent for each array.

Figure 8A:
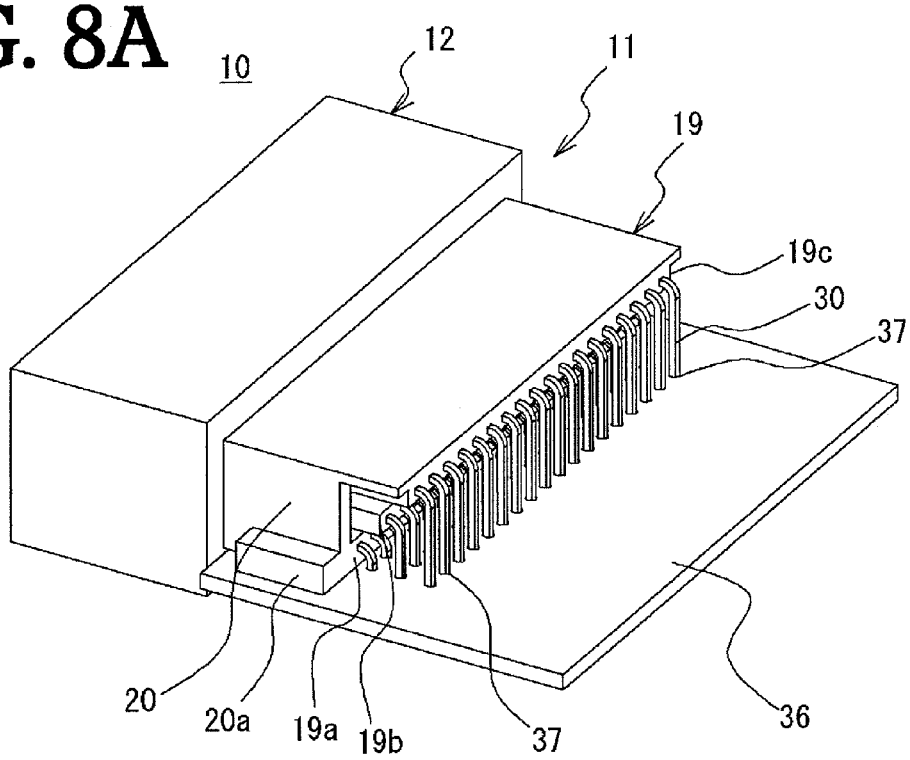
FIG. 8A is a perspective view illustrating a state where the connector is mounted on a substrate.
Figure 8B:
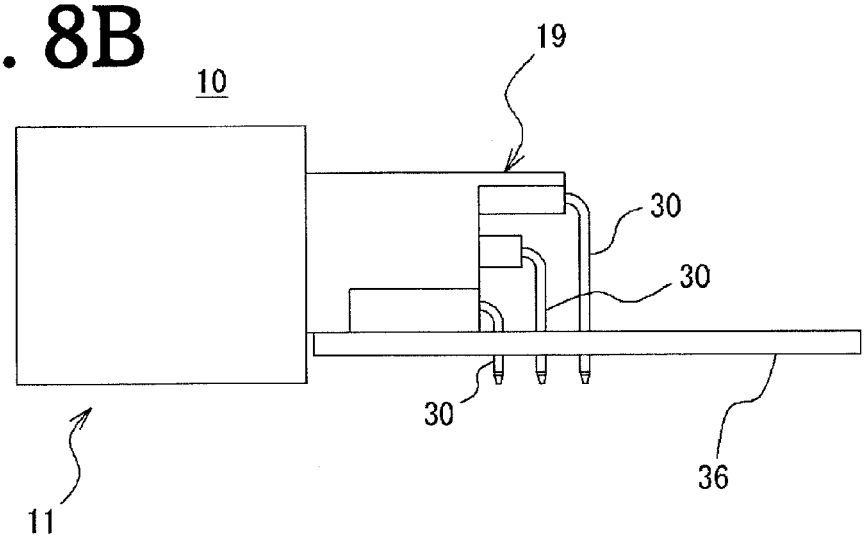
FIG. 8B is a side view thereof.

Next, the attachment of the assembled connector 10 to the substrate 36 will be described with reference to FIG. 8. The connector 10 is attached to the substrate 36 such that the leading ends 31 of the contacts 30 are inserted into a plurality of through holes 37 formed at the predetermined positions on the substrate 36. In the connector 10 according to Embodiment 1, the holding part 19 of the housing 11 in which the contacts are held is formed to be long, so that the held part of the contact is rigidly held by the holding part. The leading end 31 of the contact 30 is compensated by the first insertion hole 24 of the contact insertion hole 21. Since the leading end 31 of the contact 30 protruding from the housing 11 is short, the alignment accuracy of the leading end 31 is improved. As a result, the leading end 31 of the contact 30 can be securely inserted into the through hole 37 of the substrate 36. After that, the leading end 31 of the contact 30 inserted into the through hole 37 of the substrate 36 is soldered to the substrate 36, so that the attachment of the connector 10 to the substrate 36 is completed.

In the connector according to Embodiment 1, the contacts are provided in three arrays, but the invention is not limited thereto. The contacts may be provided in one array, or two or more arrays. In the case where the contacts are provided in two or more arrays, each of the holding parts of the housing has different length for each array, so that the substrate and the contacts are smoothly connected.

Embodiment 2

A connector according to Embodiment 2 will be described with reference to FIGS. 9 to 13. The connector described in Embodiment 1 is a so-called side-type connector, on the other hand, the connector according to Embodiment 2 is a so-called top-type connector that is vertically mounted on a substrate. In the connector according to Embodiment 2, only part of the shape of the housing and the contact is different from that of the connector according to Embodiment 1, and other components are the same. Therefore, the same components as those of the connector of Embodiment 1 will be denoted by the same reference numerals, and detailed description thereof will not be repeated here.

Figure 9:
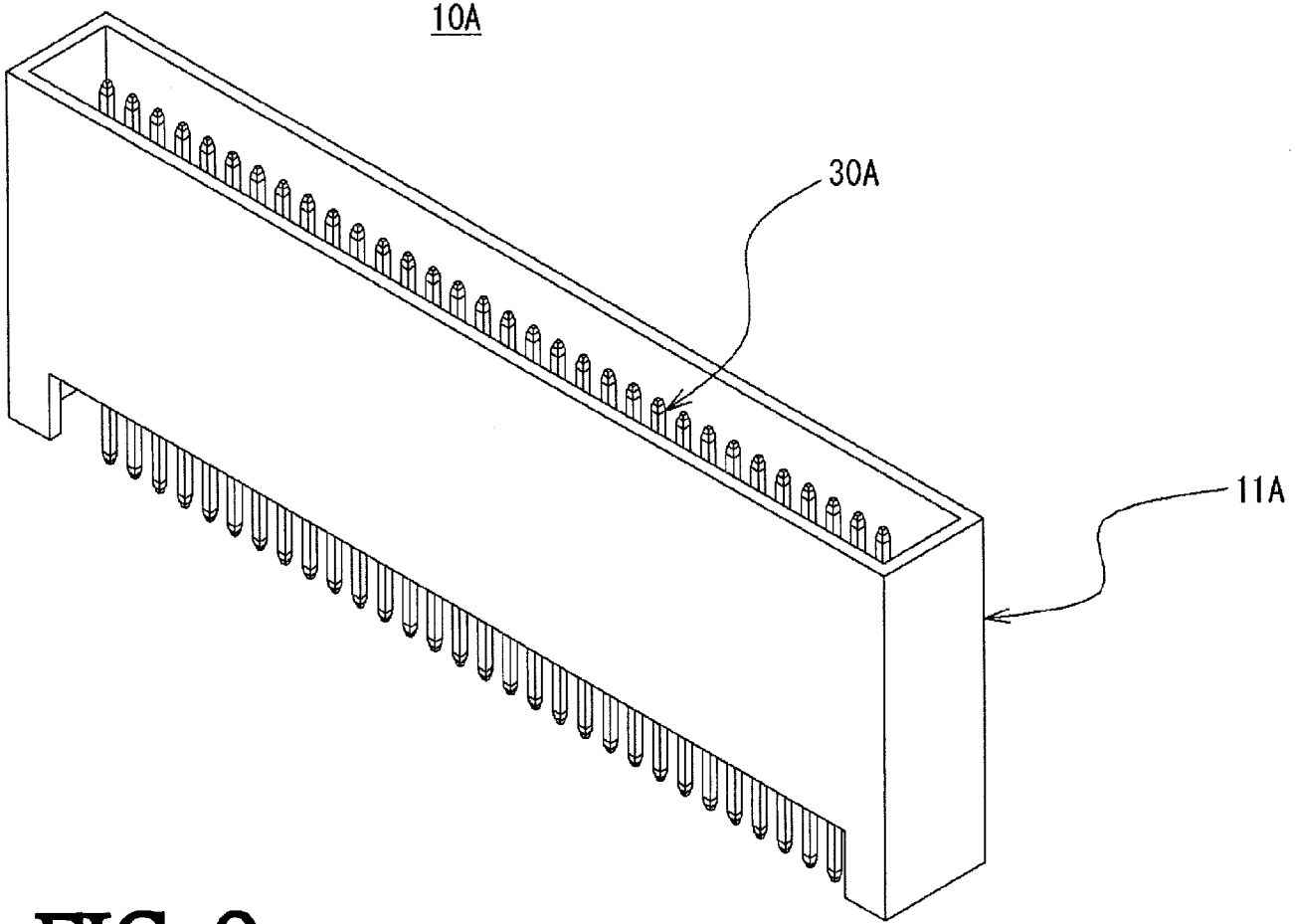
FIG. 9 is a perspective view illustrating a connector according to Embodiment 2.
Figures 10A, 10B, 10C:
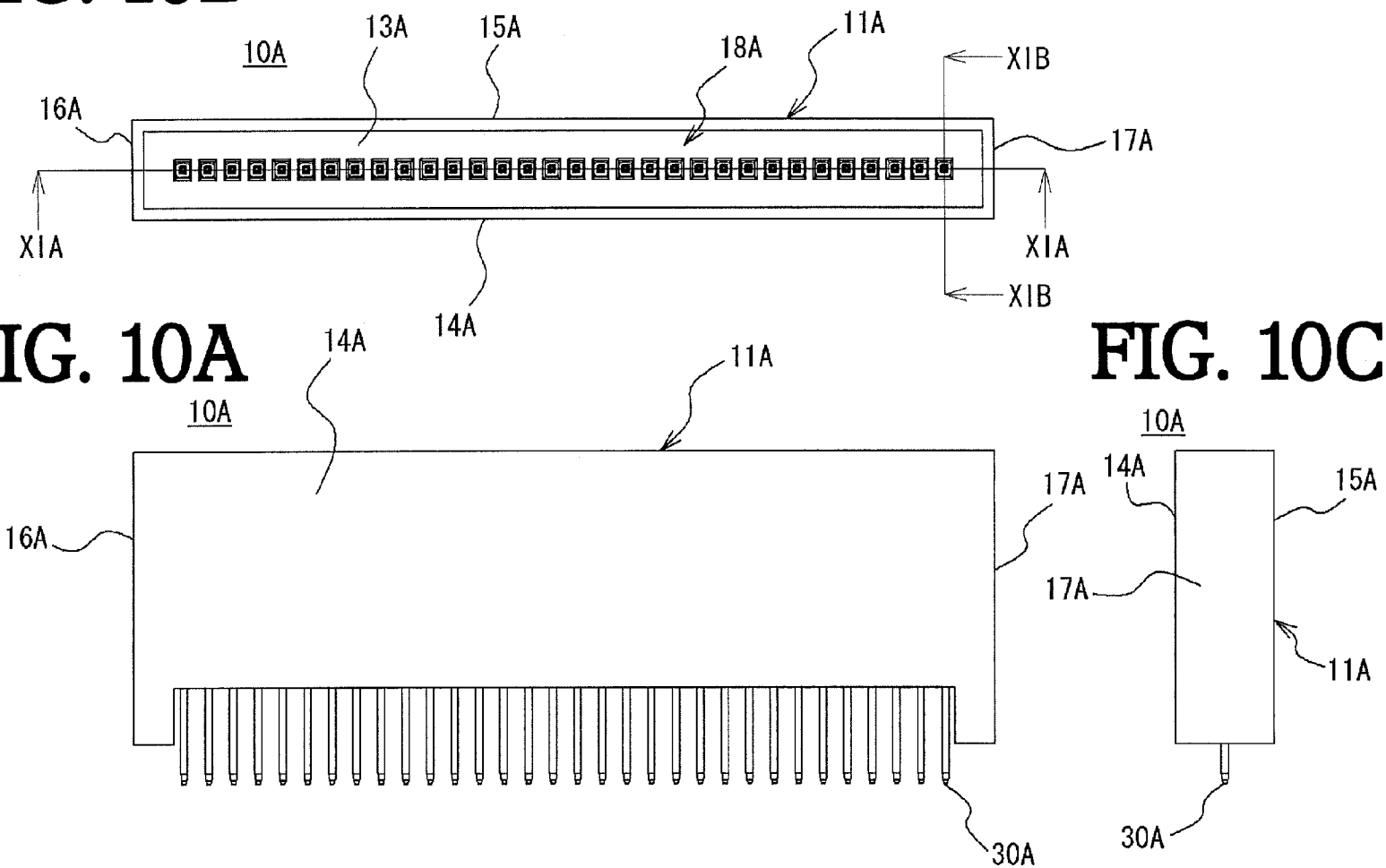
FIG. 10A is a front view of the connector according to Embodiment 2.
FIG. 10B is a top view thereof.
FIG. 10C is one side view thereof.

As illustrated in FIGS. 9 and 10, a connector 10A according to Embodiment 2 includes a housing 11A formed of insulating material and a plurality of contacts 30A mounted on the housing 11A. With respect to the connector 10A of Embodiment 2, a case where the contacts 30A are aligned in one array will be described. Since the connector 10A of Embodiment 2 is a so-called top-type connector, the contacts are formed linearly unlike the contacts 30 in Embodiment 1.

Figure 11B:
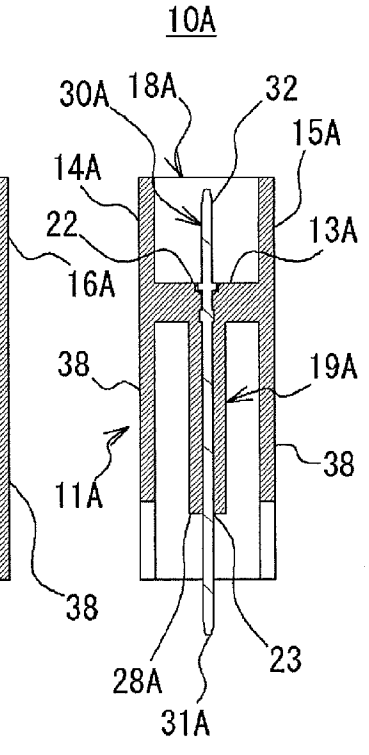
FIG. 11B is a cross sectional view taken along a line XIB-XIB of FIG. 10B.
Figure 11A:
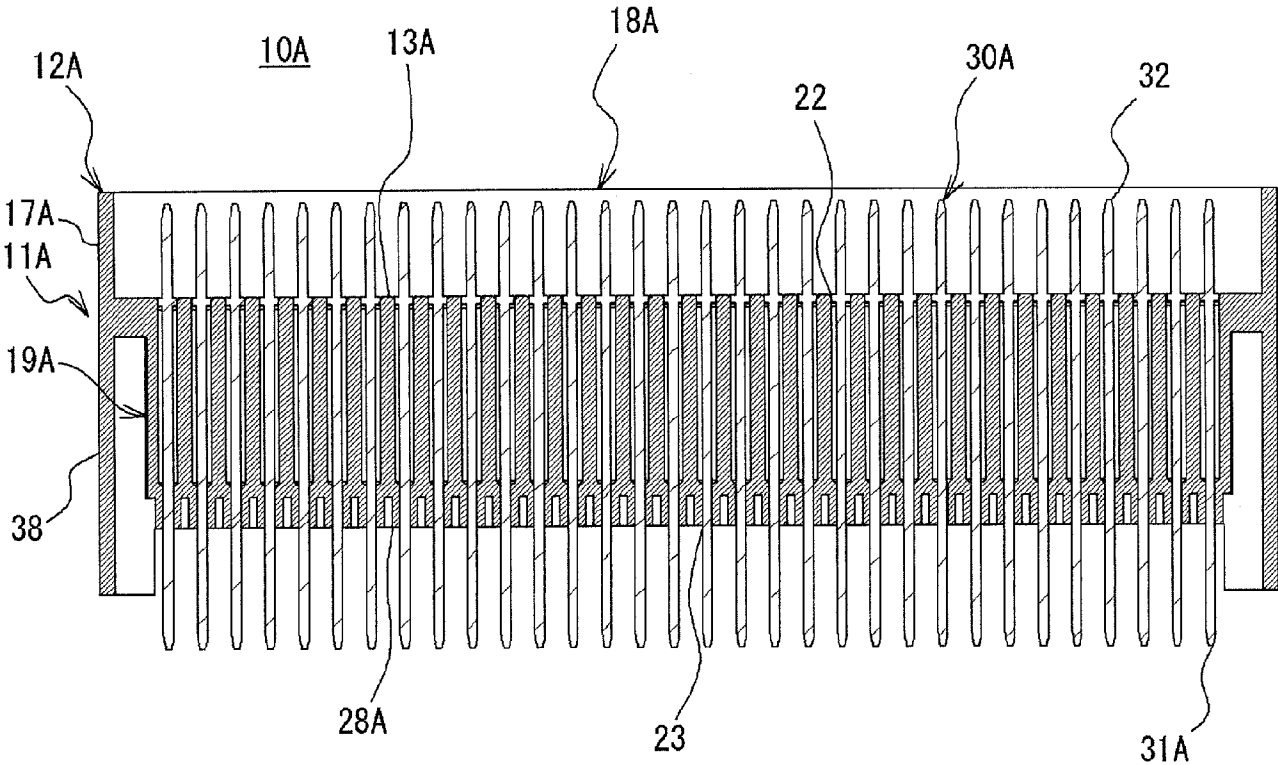
FIG. 11A is a cross sectional view taken along a line XIA-XIA of FIG. 10B.

As illustrated in FIG. 11, the housing 11A includes a mounting part 12 A mounted to a counterpart connector (not shown) and a holding part 19A extended from the mounting part 12A and holding a plurality of contacts 30A. The mounting part 12A has a configuration similar to that of the mounting part 12 in Embodiment 1. That is, the mounting part 12A is enclosed by a back wall 13A that is part of the holding part 19A, a plate-like front wall (corresponding to the upper wall 14 of Embodiment 1) 14A, a rear wall (corresponding to the lower wall 15 of Embodiment 1) 15A, and both side walls 16A and 17A that are provided at respective sides of the back wall 13A and having predetermined area and thickness. The mounting part 12A has a box shape in which an opening 18A is formed at the position opposed to the back wall 13A.

The holding part 19A is extended from the mounting part 12A of the housing 11A by a predetermined length to be long, and formed by a plate-like member as a unit for the array where the contacts 30A are arranged. In the connector 10A according to Embodiment 2, since the contacts 30A are arranged in one array, the holding part 19A is also formed by one plate-like member.

Figure 12A:
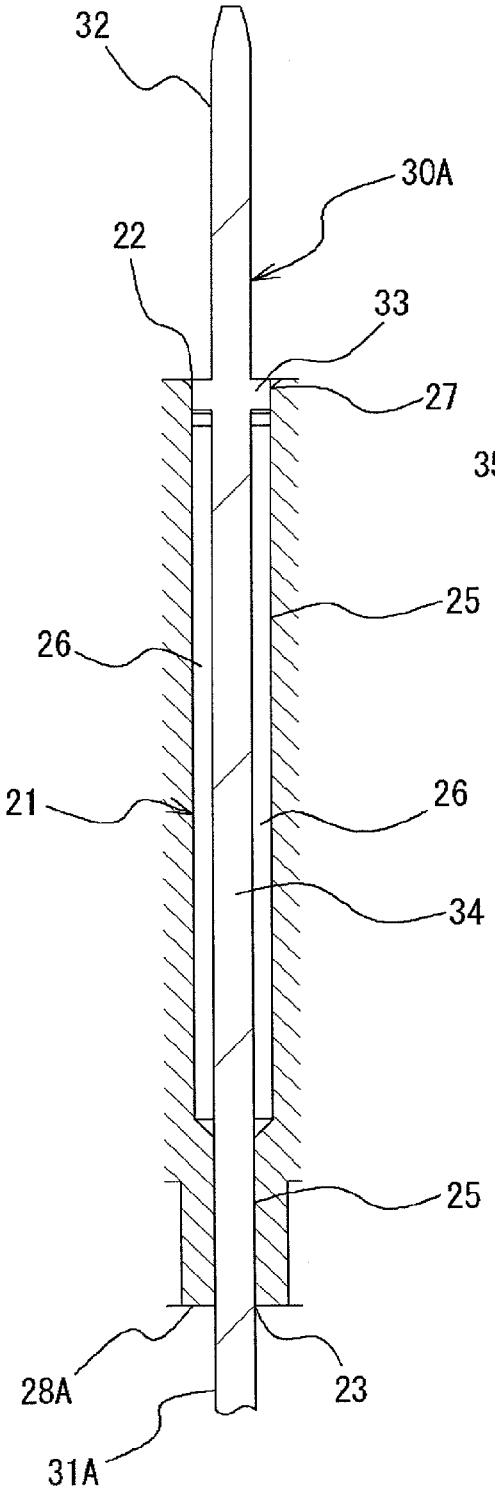
FIG. 12A is a partially enlarged view of FIG. 11A.
Figure 12B:
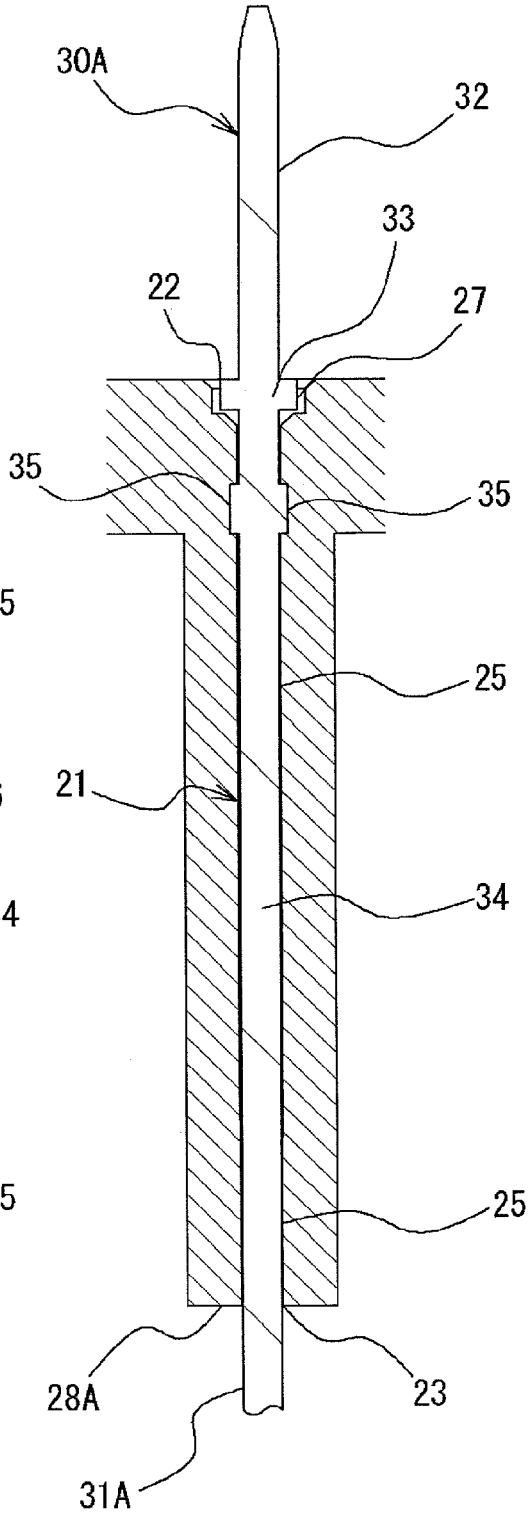
FIG. 12B is a partially enlarged view of FIG. 11B.

As illustrated in FIGS. 11 and 12, the plate-like member of the holding part 19A is extended from the back wall 13A of the mounting part 12A, and an end face 28A of the plate-like member is formed on an opposite side of the mounting part 12A. Similarly to the holding part 19 according to Embodiment 1, contact insertion holes 21 to which the contacts 30A are inserted at predetermined intervals are formed inside the plate-like member, so that an inlet 22 formed on the back wall 13A and an outlet 23 formed on the end face 28 are communicated with each other. Although the contact insertion hole 21 includes the first insertion hole 24, the second insertion hole 25 and the flange holding part 27 as with Embodiment 1, these components are the same as those of Embodiment 1, so detailed description thereof will not be repeated here.

In the holding part 19A, each of the walls 14A to 17A of the mounting part 12A is extended by a predetermined length to enclose the plate-like member of the holding part 19A, as a result, a protection wall 38 enclosing the holding part 19A is formed. An end to which the side walls 16A and 17A of the mounting part 12A in the protection wall 38 are extended is an installation part 20Aa installed on the substrate.

The contact 30A used in Embodiment 2 has a leading end 31A, the connecting part 32, the held part 34, the flange part 33, and the protruding part 35. The components thereof are the same as those of the contact 30 used in Embodiment 1 except that the shape of the leading end 31A is linear.

The connector 10A of Embodiment 2 is assembled in the same manner as the connector 10 of Embodiment 1. Specifically, the leading end 31A side of the contact 30A is inserted from the mounting part 12A side of the housing 11A into the contact insertion hole 21 of the holding part 19A. The contact 30A is not bent and remains in linear shape even after being mounted on the housing 11A.

Figure 13A:
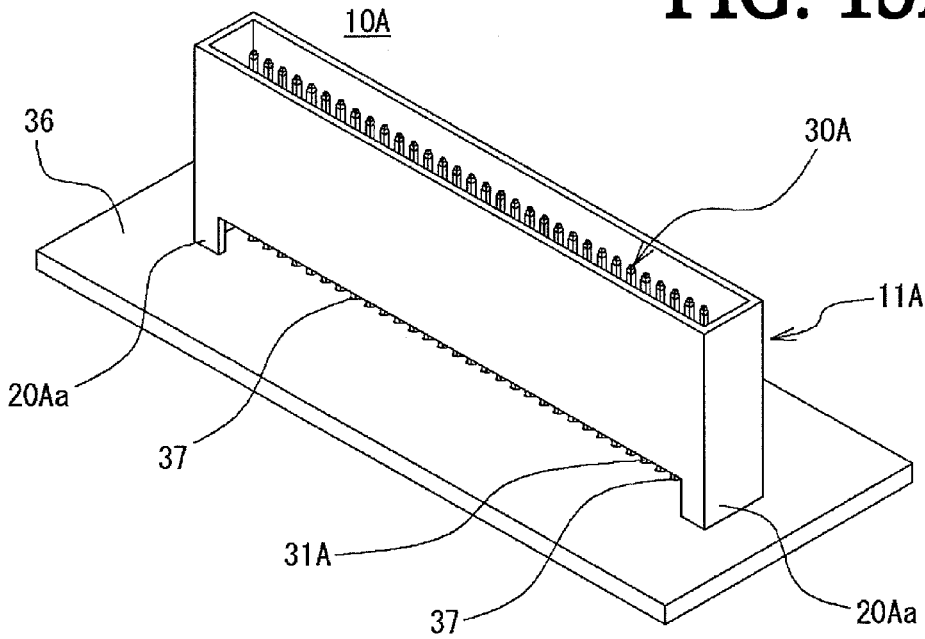
FIG. 13A is a perspective view illustrating a state where the connector of Embodiment 2 is mounted on the substrate.
Figure 13B:
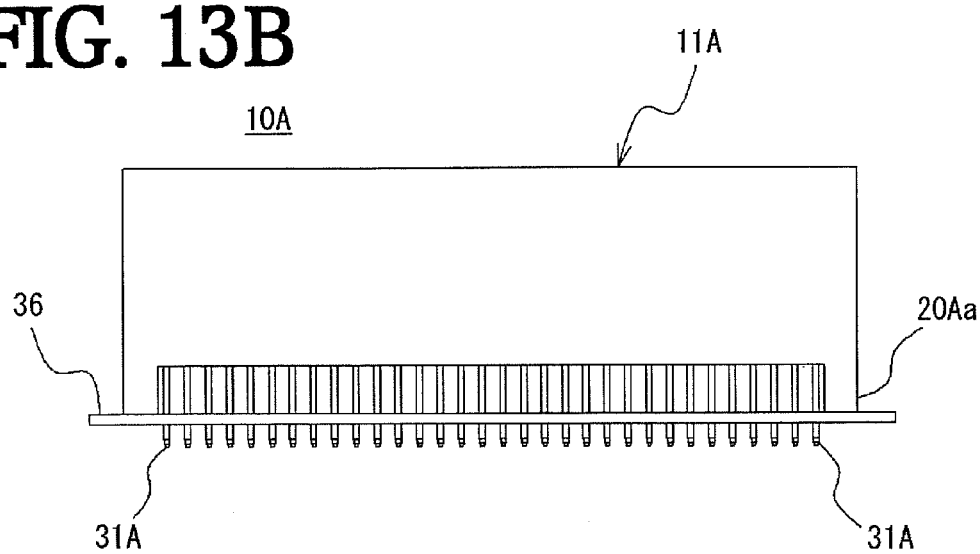
FIG. 13B is a front view thereof.

Next, the mounting of the connector 10A to the substrate 36 according to Embodiment 2 will be described with reference to FIG. 13. The connector 10A according to Embodiment 2 is a so-called top-type connector 10A, so that it is vertically mounted on the substrate 36. Specifically, the leading ends 31A of the contacts 30A of the connector 10A is inserted into the through holes 37 formed on the substrate 36. Similarly to the connector 10 according to Embodiment 1, in the connector 10A according to Embodiment 2, the contact 30A is held by the holding part 19A formed to be long, so that the alignment accuracy of the leading end 31A of the contact 30A can be improved. Therefore, even a so-called top-type connector 10A can be accurately inserted into the through hole.

In the connectors 10 and 10A according to Embodiments 1 and 2, the space 26 is formed in the second insertion hole 25 so as to facilitate the insertion of the contact into the contact insertion hole of the housing. However, the space 26 may be filled with filler. As a result, the airtightness of the housing can be enhanced, excellent waterproof property and dust resistance can be obtained, and the holding power of the contact can be more enhanced. Known seal material or hot melt adhesives may be used as the filler.

In Embodiments 1 and 2, the case where the cross-sectional shape of the contact is a square shape is described, but the invention is not limited thereto. The cross-sectional shape of the contact may be a rectangle, a circle, or an ellipse. Accordingly, the contact may be selected depending on the use mode, so that the range of design can be expanded. Even if the cross-sectional shape of the contact is any of a square, a rectangle, a circle, or an ellipse, the protruding part is formed on the contact, the orientation of the contact can be determined by press-fitting the protruding part, and the rotation of the contact can be prevented.

What is claimed is:

1. A connector for attaching to a substrate comprising:

a hosing; and a plurality of contacts held in the housing, the housing including:

a mounting part to which a counterpart connector is mounted; and a holding part extended from the mounting part and holding the contacts, each of the contacts including:

a leading end protruding from the housing;

a connecting part connected with the counterpart connector on the opposite side of the leading end;

a held part held by the holding part of the housing; and a flange part formed on the held part at the near side of the connecting part, the holding part of the housing having a contact insertion hole into which the held part of the contact is inserted, the contact insertion hole including:

a first insertion hole formed in a size that holds a side surface of the held part of the contact on the opposite side of the mounting part of the housing;

a second insertion hole communicating with the first insertion hole and formed in a size that holds one opposite side surfaces of the held part of the contact, and that leaves spaces between the other opposite side surfaces of the held part of the contact and the inner surface of the second insertion hole, the second insertion hole being formed to be longer than the first insertion hole; and a flange holding part that holds the flange part of the contact on the mounting part side of the second insertion hole, and the held part of the contact being longer than the leading end of the contact.

2. The connector according to claim 1, wherein the held part of the contact includes a protruding part protruding from a side surface which is held in the second insertion hole.

3. The connector according to claim 1, wherein the housing is arranged so that the contact insertion hole is parallel to the substrate, the housing has at least two arrays of such contact insertion holes, the contact is formed so that the leading end bends toward the substrate, the holding part of the housing is formed to be the shortest at a lower portion of the housing which is closest to the substrate and is formed to be longer toward an upper portion of the housing.

4. The connector according to claim 2, wherein the housing is arranged so that the contact insertion hole is parallel to the substrate, the housing has at least two arrays of such contact insertion holes, the contact is formed so that the leading end bends toward the substrate, the holding part of the housing is formed to be the shortest at a lower portion of the housing which is closest to the substrate and is formed to be longer toward an upper portion of the housing.

5. The connector according to claim 3, wherein the holding part is integrally formed with each of the arrays.

6. The connector according to claim 4, wherein the holding part is integrally formed with each of the arrays.

7. The connector according to claim 3, wherein the leading end of the contact is bent immediately after protruding from the holding part of the housing.

8. The connector according to claim 4, wherein the leading end of the contact is bent immediately after protruding from the holding part of the housing.

9. The connector according to claim 5, wherein the leading end of the contact is bent immediately after protruding from the holding part of the housing.

10. The connector according to claim 6, wherein the leading end of the contact is bent immediately after protruding from the holding part of the housing.

11. The connector according to claim 1, wherein
the housing has at least an array of such contact insertion holes, and
the contacts are formed linearly.

12. The connector according to claim 2, wherein
the housing has at least an array of such contact insertion holes, and
the contacts are formed linearly.

13. The connector according to claim 1, wherein the contacts are formed of wire rods.

14. The connector according to claim 1, wherein each of the contacts has a cross-sectional shape of a square, a rectangle, a circle, or an ellipse.

15. The connector according to claim 1, wherein the space in the second insertion hole of the housing is filled with filler.

* * * * *